US008274499B2

(12) United States Patent
Takahashi

(10) Patent No.: US 8,274,499 B2
(45) Date of Patent: Sep. 25, 2012

(54) METHOD FOR DRIVING PIXEL CIRCUIT, ELECTRO-OPTIC DEVICE, AND ELECTRONIC APPARATUS

(75) Inventor: Kasori Takahashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1266 days.

(21) Appl. No.: 12/028,524

(22) Filed: Feb. 8, 2008

(65) Prior Publication Data

US 2008/0218497 A1 Sep. 11, 2008

(30) Foreign Application Priority Data

Mar. 8, 2007 (JP) ..... 2007-058186

(51) Int. Cl.
*G09G 5/00* (2006.01)

(52) U.S. Cl. ..... 345/204

(58) Field of Classification Search ..... 345/204
See application file for complete search history.

(56) References Cited

U.S. PATENT DOCUMENTS

| | | | | |
|---|---|---|---|---|
| 6,229,508 | B1 * | 5/2001 | Kane | 345/82 |
| 6,356,029 | B1 * | 3/2002 | Hunter | 315/169.1 |
| 6,583,775 | B1 * | 6/2003 | Sekiya et al. | 345/76 |
| 7,042,426 | B2 * | 5/2006 | Shin | 345/76 |
| 7,259,735 | B2 * | 8/2007 | Kasai | 345/77 |
| 2004/0070557 | A1 * | 4/2004 | Asano et al. | 345/76 |
| 2006/0061560 | A1 * | 3/2006 | Yamashita et al. | 345/204 |
| 2006/0170628 | A1 * | 8/2006 | Yamashita et al. | 345/76 |
| 2007/0115225 | A1 * | 5/2007 | Uchino et al. | 345/76 |
| 2007/0152920 | A1 * | 7/2007 | Yamashita et al. | 345/76 |
| 2007/0247399 | A1 * | 10/2007 | Yamashita et al. | 345/82 |
| 2007/0273620 | A1 * | 11/2007 | Yumoto | 345/76 |
| 2007/0273621 | A1 * | 11/2007 | Yamashita et al. | 345/76 |

FOREIGN PATENT DOCUMENTS

| | | | |
|---|---|---|---|
| JP | 2006-251632 | | 9/2006 |
| JP | 2006317600 A | * | 11/2006 |
| JP | A-2006-317600 | | 11/2006 |

* cited by examiner

*Primary Examiner* — William Boddie
*Assistant Examiner* — Carolyn R Edwards
(74) *Attorney, Agent, or Firm* — Oliff & Berridge, PLC

(57) ABSTRACT

There is provided a method for driving a pixel circuit including a light-emitting element that emits light whose amount corresponds to a driving current, a driver transistor that supplies the driving current to the light-emitting element, a first transistor provided between a gate of the driver transistor and a drain of the driver transistor, a second transistor provided between the drain of the driver transistor and a node used to supply an initialization potential, and a capacitive element one terminal of which is connected to the gate of the driver transistor. In an initialization period in which the first transistor is turned on, the method for driving a pixel circuit includes supplying a fixed potential to the other terminal of the capacitive element and supplying a predetermined potential allowing the second transistor to be operated in a saturation region thereof to a gate of the second transistor. In a writing period after the initialization period is finished, the method for driving a pixel circuit includes supplying a potential corresponding to a gradation to be displayed to the other terminal of the capacitive element.

6 Claims, 13 Drawing Sheets

METHOD FOR DRIVING PIXEL CIRCUIT, ELECTRO-OPTIC DEVICE, AND ELECTRONIC APPARATUS

BACKGROUND

1. Technical Field

The present invention relates to a technology for controlling the behaviors of various types of electro-optic elements, such as light-emitting elements formed of an organic electroluminescent (EL) material.

2. Related Art

Regarding an electro-optic element of one of these types, a gradation (typically, a luminance) thereof is changed by supplying a current thereto. A configuration in which this current (hereinafter, referred to as a "driving current") is controlled by a transistor (hereinafter, referred to as a "driver transistor") has been suggested in the related art.

Since there is a problem that a variation in gradation among electro-optic elements occurs due to a variation in mobility among driver transistors, in order to solve the problem, for example, JP-A-2006-251632 (Paragraph 0028) discloses a configuration in which a resistor is provided between a driver transistor and a power supply to realize a self-correction of a driver transistor.

However, because in the technology of the configuration disclosed in JP-A-2006-251632 (Paragraph 0028), a resistor is provided in a path running from a power supply to a driver transistor, there is a problem that this resistor consumes power. Additionally, the increase of a dimension occupied by the resistor results in reduction of a dimension of a light-emitting element in a pixel circuit, thereby causing a problem of reducing an aperture ratio.

SUMMARY

An advantage of some aspects of the invention is that power consumption can be reduced, and at the same time, a variation in mobility of a driver transistor can be corrected without reducing an aperture ratio.

According to a first aspect of the invention, there is provided a method for driving a pixel circuit including a light-emitting element that emits light whose amount corresponds to a driving current, a driver transistor that supplies the driving current to the light-emitting element, a first transistor provided between a gate of the driver transistor and a drain of the driver transistor, a second transistor provided between the drain of the driver transistor and a node used to supply an initialization potential, and a capacitive element one terminal of which is connected to the gate of the driver transistor. In an initialization period in which the first transistor is turned on, the method for driving a pixel circuit includes supplying a fixed potential (for example, Vini shown in FIG. 2) to the other terminal of the capacitive element and supplying a predetermined potential allowing the second transistor to be operated in a saturation region thereof to a gate of the second transistor. In a writing period after the initialization period is finished, the method for driving a pixel circuit includes supplying a potential corresponding to a gradation to be displayed to the other terminal of the capacitive element.

With this method, in the initialization period, since the first transistor is turned on, the driver transistor is diode-connected. In such a case, because the second transistor is operated in the saturation region thereof, the gate of the driver transistor is biased at a potential obtained in accordance with the mobility of the driver transistor, thereby obtaining a gate potential of the driver transistor. The gate potential of the driver transistor is maintained across a gate capacitance thereof. Accordingly, in the writing period, when a data potential corresponding to a gradation is supplied to the other terminal of the capacitive element, the data potential is superimposed on the potential obtained in accordance with the mobility at the gate of the driver transistor, and the superimposed potential is maintained across the gate capacitance. As a result, the mobility of the driver transistor can be corrected. Furthermore, because no resistor is used, power to be consumed by a resistor can be reduced, and an aperture ratio can be improved.

It is preferable that the method for driving a pixel circuit include supplying the fixed potential to the other terminal of the capacitive element and supplying a potential allowing the second transistor to be turned off to the gate of the second transistor in a compensation period provided between the initialization period and the writing period. In the first aspect of the invention, a gate-to-source voltage of the driver transistor can be approached to the threshold voltage thereof in the compensation period. More specifically, in a case where the mobility and the threshold voltage of the second transistor vary, when the initialization period is finished, a gate potential influenced by the characteristic variation of the second transistor is maintained at the gate of the driver transistor. In the compensation period, the gate potential of the driver transistor is changed so as to reach the threshold voltage thereof. Accordingly, even when the characteristic of the second transistor varies, the negative effect caused by the variation can be reduced. Thus, since the compensation period is provided, the mobility and the threshold voltage can be corrected. Furthermore, a luminance variation due to the characteristic variation of the second transistor can be suppressed. Any constant potential may be used as the fixed potential. However, when the fixed potential is set to the initialization potential, the number of power supplies can be decreased. Additionally, the compensation period is preferably finished before the gate potential of the driver transistor, i.e., the gate-to-source voltage, reaches the threshold voltage.

According to a second aspect of the invention, an electro-optic device includes: a plurality of data lines; a plurality of scanning lines; a plurality of pixel circuits provided in correspondence with intersections of the plurality of data lines and the plurality of scanning lines, each of the plurality of pixel circuits including a driver transistor that generates a driving current on the basis of a potential of a gate of the driver transistor, an electro-optic element having a gradation obtained on the basis of the driving current generated by the driver transistor, a capacitive element having one terminal connected to the gate of the driver transistor, a first transistor which is provided between the gate of the driver transistor and a drain of the driver transistor, and a gate of which is supplied with a first control signal defining an initialization period, a second transistor which is provided between the drain of the driver transistor and a node used to supply an initialization potential, and a gate of which is supplied with a second control signal defining the initialization period, a third transistor which is provided between the node and the other terminal of the capacitive element, and a gate of which is supplied with the first control signal, and a fourth transistor which is provided between the other terminal of the capacitive element and a corresponding one of the plurality of data lines, and a gate of which is supplied with a scanning signal defining a writing period via a corresponding one of the plurality of scanning lines; a first driving unit (for example, denoted by the reference numeral 24 in FIG. 1) that supplies a data potential corresponding to a gradation to a corresponding one of the plurality of data lines; and a second driving unit (for example, denoted by the reference numeral 22 in FIG. 1) that generates the first and second control signals and supplies the scanning signal to a corresponding one of the plurality of scanning lines. The second driving unit sets a potential of the first control signal in the initialization period to a potential allowing the first and third transistors to be turned on and sets a potential of the first control signal in the writing period to a potential allowing the first and third transistors to be turned off. Additionally, the second driving unit sets a potential of the second control signal in the initialization period to a predetermined potential allowing the second transistor to be operated in a saturation region thereof and sets a potential of the second control signal in the writing period to a potential allowing the second transistor to be turned off. Furthermore, the second driving unit sets a potential of the scanning signal in the initialization period to a potential allowing the fourth transistor to be turned off and sets a potential of the scanning signal in the writing period to a potential allowing the fourth transistor to be turned on.

In the second aspect of the invention, in the initialization period, since the potential of the first control signal is set to the potential allowing the first transistor to be turned on, the driver transistor is diode-connected. In this case, since the potential of the second control signal is set to the predetermined potential allowing the second transistor to be operated in the saturation region thereof, the gate of the driver transistor is biased at a potential obtained in accordance with the mobility thereof, thereby obtaining a gate potential of the driver transistor. The gate potential of the driver transistor is maintained across a gate capacitance thereof. Accordingly, in the writing period, when the fourth transistor is turned on to supply a data potential corresponding to a gradation to the other terminal of the capacitive element, the data potential is superimposed on the potential obtained in accordance with the mobility at the gate of the driver transistor, and the superimposed potential is maintained across the gate capacitance. As a result, the mobility of the driver transistor can be corrected. Furthermore, because no resistor is used, power to be consumed by a resistor can be reduced, and an aperture ratio can be improved.

According to a third aspect of the invention, an electro-optic device includes: a plurality of data lines; a plurality of scanning lines; a plurality of pixel circuits provided in correspondence with intersections of the plurality of data lines and the plurality of scanning lines, each of the plurality of pixel circuits including a driver transistor that generates a driving current on the basis of a potential of a gate of the driver transistor, an electro-optic element having a gradation obtained on the basis of the driving current generated by the driver transistor, a capacitive element having one terminal connected to the gate of the driver transistor, a first transistor which is provided between the gate of the driver transistor and a drain of the driver transistor, and a gate of which is supplied with a first control signal defining an initialization period and a compensation period, a second transistor which is provided between the drain of the driver transistor and a node used to supply an initialization potential, and a gate of which is supplied with a second control signal defining the initialization period, a third transistor which is provided between the node and the other terminal of the capacitive element, and a gate of which is supplied with the first control signal, and a fourth transistor which is provided between the other terminal of the capacitive element and a corresponding one of the plurality of data lines, and a gate of which is supplied with a scanning signal defining a writing period via a corresponding one of the plurality of scanning lines; a first driving unit that supplies a data potential corresponding to a gradation to a corresponding one of the plurality of data lines; and a second driving unit that generates the first and second control signals and supplies the scanning signal to a corresponding one of the plurality of scanning lines. The second driving unit sets a potential of the first control signal in the initialization period and the compensation period to a potential allowing the first and third transistors to be turned on and sets a potential of the first control signal in the writing period to a potential allowing the first and third transistors to be turned off. Additionally, the second driving unit sets a potential of the second control signal in the initialization period to a predetermined potential allowing the second transistor to be operated in a saturation region thereof and sets a potential of the second control signal in the compensation period and the writing period to a potential allowing the second transistor to be turned off. Furthermore, the second driving unit sets a potential of the scanning signal in the initialization period and the compensation period to a potential allowing the fourth transistor to be turned off and sets a potential of the scanning signal in the writing period to a potential allowing the fourth transistor to be turned on.

In the third aspect of the invention, in the compensation period, the potential of the second control signal is set to the potential allowing the second transistor to be turned off. Accordingly, in the initialization period, the driver transistor is diode-connected, and the gate of the driver transistor is biased at the initialization potential, thereby obtaining a gate potential of the driver transistor. However, in the compensation period, the gate potential of the driver transistor is changed to a potential obtained by subtracting the threshold voltage of the driver transistor from a potential of the source of the driver transistor. This enables the gate potential of the driver transistor to be changed in accordance with the threshold thereof. As a result, not only the mobility but also the threshold can be corrected. Additionally, since the gate potential of the driver transistor is changed so as to reach the threshold voltage in the compensation period, even when the characteristic of the second transistor varies, the negative effect caused by the variation can be reduced. Furthermore, the compensation period is preferably finished before the gate potential of the driver transistor, i.e., the gate-to-source voltage, reaches the threshold voltage.

It is preferable that in the electro-optic device described above, each of the plurality of pixel circuits further include a fifth transistor which is provided between the driver transistor and the electro-optic element, and a gate of which is supplied with a third control signal defining a light-emitting period. It is also preferable that the second driving unit set a potential of the first control signal in the initialization period and the compensation period to the potential allowing the first and third transistors to be turned on, and set a potential of the first control signal in the writing period and the light-emitting period to the potential allowing the first and third transistors to be turned off. Additionally, it is preferable that the second driving unit set a potential of the second control signal in the initialization period to the predetermined potential allowing the second transistor to be operated in a saturation region thereof, and set a potential of the second control signal in the compensation period, the writing period, and the light-emitting period to the potential allowing the second transistor to be turned off. Moreover, it is preferable that the second driving unit set a potential of the scanning signal in the initialization period, the compensation period, and the light-emitting period to the potential allowing the fourth transistor to be turned off, and set a potential of the scanning signal in the writing period to a potential allowing the fourth transistor to be turned on. Furthermore, it is preferable that the second driving unit set a potential of the third control signal in the initialization period, the compensation period, and the writing period to a potential allowing the fifth transistor to be turned off, and set a potential of the third control signal in the light-emitting period to a potential allowing the fifth transistor to be turned on. In the third aspect of the invention, a driving current can be supplied on the basis of a gate potential of the driver transistor, which is set in the writing period, to the electro-optic element. Thus, the electro-optic element can emit light to obtain a luminance on the basis of a corrected mobility.

According to a fourth aspect of the invention, there is provided an electronic apparatus including the above-described electro-optic device. A typical example of such an electronic apparatus is an apparatus that utilizes the electro-optic device as a display device. An electronic apparatus of this type may be, for example, a personal computer or a mobile phone. The application of an electro-optic device according to an aspect of the invention is not limited to displaying of an image. For example, in an image-forming apparatus (printer) having a configuration in which a latent image is formed on an image carrier, such as a photosensitive drum, by exposing the image carrier to a light beam, an electro-optic device according to an aspect of the invention can be used as a unit that exposes the image carrier, which is called an exposure head. Additionally, in the above-described aspects of the invention, any element that emits light whose amount corresponds to a driving current can be used as a light-emitting element. For example, a light-emitting diode, such as an organic light-emitting diode or an inorganic light-emitting diode, can be used.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A: Configuration of Electro-Optic Device

Figure 1:
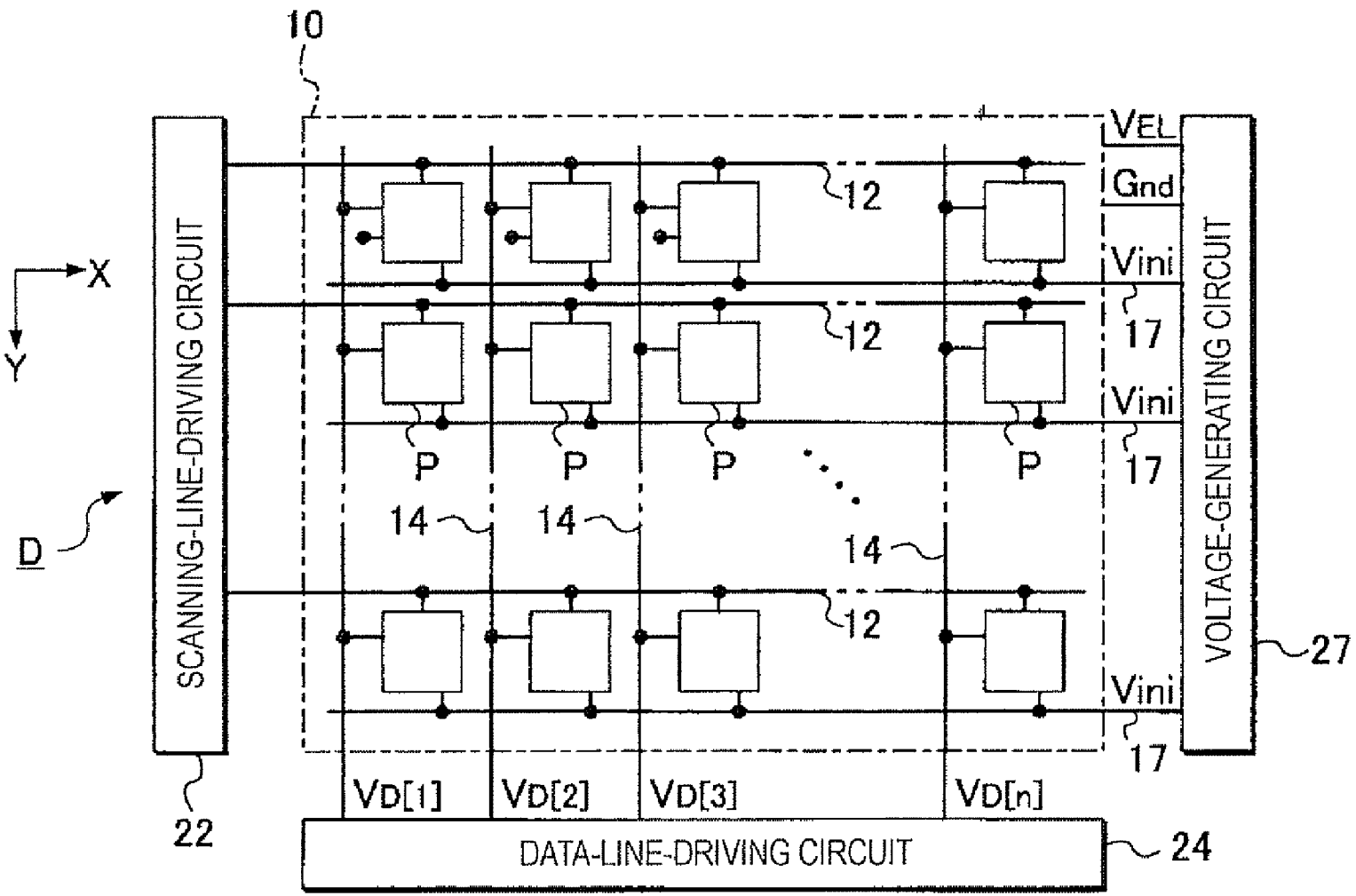
FIG. 1 is a block diagram of the configuration of an electro-optic device according to a first embodiment of the invention.

FIG. 1 is a block diagram of the configuration of an electro-optic device according to a first embodiment of the invention. An electro-optic device D is one of devices employed in various types of electronic apparatuses as units that display images. The electro-optic device D includes a pixel array unit 10 in which pixel circuits P are disposed in the form of a plane, a scanning-line-driving circuit 22 and a data-line-driving circuit 24 that drive the pixel circuits P, and a voltage-generating circuit 27 that generates voltages used in the electro-optic device D. Referring to FIG. 1, the scanning-line-driving circuit 22, the data-line-driving circuit 24, and the voltage-generating circuit 27 are shown as discrete circuits, but a configuration in which a portion of these circuits or all of these circuits are configured into a single circuit may be employed. Additionally, one scanning-line-driving circuit 22 (or one data-line-driving circuit 24 or one voltage-generating circuit 27) shown in FIG. 1 that is separated so as to be disposed in integrated circuit (IC) chips may be implemented in the electro-optic device D.

As shown in FIG. 1, in the pixel array unit 10, m control lines 12 extending in the X direction, n data lines 14 extending in the Y direction perpendicular to the X direction, and m feeders 17 extending in the x direction, each of which is parallel to a corresponding one of the control lines 12, are formed (where m and n are natural numbers). Each of the pixel circuits P is disposed at a position corresponding to an intersection of a corresponding one of the data lines 14, a corresponding one of the control lines 12, and a corresponding one of the feeders 17. Accordingly, the pixel circuits P are disposed in a matrix of m rows in the vertical direction and n columns in the horizontal direction.

The scanning-line-driving circuit 22 selects the pixel circuits P on a row-by-row basis in every horizontal scanning period. The data-line-driving circuit 24 generates data potentials VD[1] to VD [n] each of which corresponds to a corresponding one of n pieces of the pixel circuits P, which are disposed in one of the rows that is selected by the scanning-line-driving circuit 22 in a horizontal scanning period, and outputs the data potentials VD[1] to VD [n] to the data lines 14. In a horizontal scanning period in which an i-th row (where i is an integer satisfying $1 \leqq i \leqq m$) is selected, one of the data potentials that is output to a corresponding one of the data lines 14 which is located in a j-th column (where j is an integer satisfying $1 \leqq j \leqq n$), namely, a data potential VD[j], corresponds to a gradation specified for a pixel circuit P located in the i-th row and the j-th column.

The voltage-generating circuit 27 generates a potential on a high potential side of a power supply (hereinafter, referred to as a "power supply potential"), namely, a power supply potential VEL, and a potential on a low potential side of the power supply (hereinafter, referred to as a "ground potential"), namely, a ground potential Gnd, and an initialization potential Vini that is constantly maintained. The initialization potential Vini is output commonly to all of the feeders 17 to be fed to the pixel circuits P.

Next, the configuration of each of the pixel circuits P will be described with reference to FIG. 2. Although only one pixel circuit P located in the i-th row and the j-th column is shown in FIG. 2, the other pixel circuits P have the same configuration.

Figure 2:
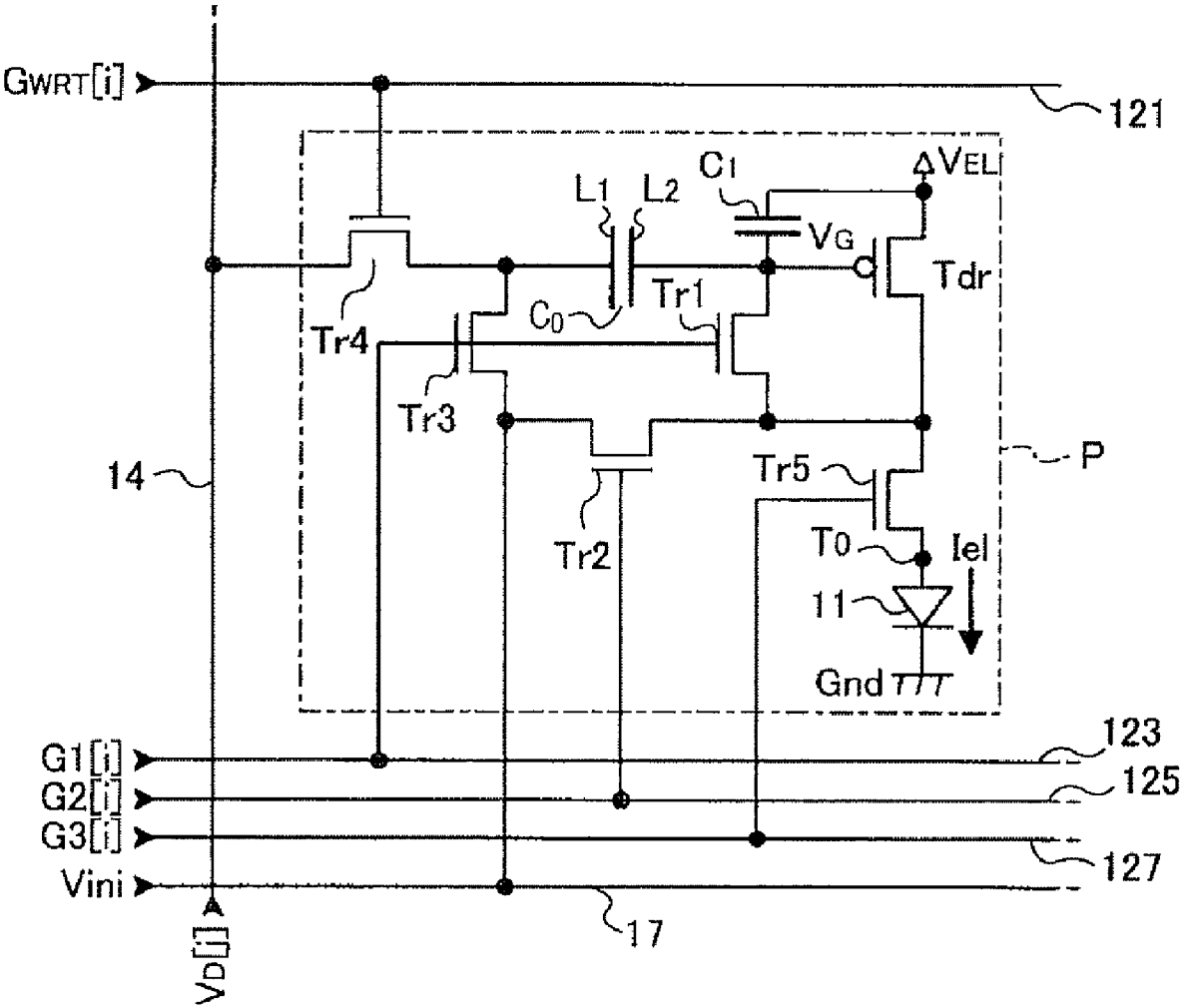
FIG. 2 is a circuit diagram of the configuration of a pixel circuit.

As shown in FIG. 2, the pixel circuit P includes an electro-optic element 11 inserted between a power supply line supplying the power supply potential VEL and a ground line supplying the ground potential Gnd. The electro-optic element 11 is a current-driven-type light-emitting element that emits light to obtain a luminance on the basis of a driving current Iel supplied to the electro-optic element 11. Typically, the electro-optic element 11 is an organic light-emitting diode (OLED) in which a light-emitting layer formed of an organic electroluminescent material is sandwiched between an anode and a cathode.

As shown in FIG. 2, although each of the control lines 12 is appropriately shown as one wiring pattern in FIG. 1, more specifically, the control line 12 includes four wiring patterns (a scanning line 121, a first control line 123, a second control line 125, and a third control line 127). The scanning-line-driving circuit 22 supplies predetermined signals to these four wiring patterns. For example, the scanning line 121 in the i-th row is supplied with a scanning signal GWRT[i] for selecting the pixel circuits P in the i-th row. The first and second control lines 123 and 125 are supplied with first and second control signals G1[*i*] and G2[*i*], respectively. In the first embodiment, the first and second control signals G1[*i*] and G2[*i*] define an initialization period in which the mobility of a driver transistor Tdr is corrected. Additionally, the third control line 127 is supplied with a third control signal G3[*i*] that defines a light-emitting period in which the electro-optic element 11 emits light, namely, a light-emitting period PEL, which is described below. The specific waveforms of signals and operations of one of the pixel circuits P in response to the signals will be describe below.

As shown in FIG. 2, in a path running from the power supply line to the anode of the electro-optic element 11, the p-channel driver transistor Tdr and an n-channel fifth transistor Tr5 are inserted. The driver transistor Tdr is a unit that generates the driving current Iel on the basis of a gate potential VG thereof. The source and drain of the driver transistor Tdr are connected to the power supply line and the drain of the fifth transistor Tr5, respectively. The fifth transistor Tr5 is a unit that defines a period in which the driving current Iel is supplied to the electro-optic element 11. The source and gate of the fifth transistor Tr5 are connected to the anode of the electro-optic element 11 and the third control line 127, respectively. Accordingly, in a period in which the third control signal G3[*i*] is maintained at a low level, the fifth transistor Tr5 is turned off, whereby the supply of the driving current Iel to the electro-optic element 11 is blocked. In contrast, when the level of the third control signal G3[*i*] becomes high, the fifth transistor Tr5 is turned on, whereby the driving current Iel is supplied to the electro-optic element 11. The fifth transistor Tr5 may be inserted between the driver transistor Tdr and the power supply line.

An n-channel first transistor Tr1 is inserted between the gate and drain of the driver transistor Tdr. The gate of the first transistor Tr1 is connected to the first control line 123. Accordingly, when the level of the first control signal G1[*i*] becomes high, the first transistor Tr1 is turned on, whereby the driver transistor Tdr is diode-connected. In contrast, the level of the first control signal G1[*i*] becomes low, the first transistor Tr1 is turned off, whereby the diode connection of the driver transistor Tdr is released.

A capacitive element C0 shown in FIG. 2 is charged by a voltage developed between a first electrode L1 and a second electrode L2 thereof. The second electrode L2 is connected to the gate of the driver transistor Tdr. An n-channel fourth transistor Tr4 is inserted between the first electrode L1 of the capacitive element C0 and a corresponding data line 14, and an n-channel third transistor Tr3 is inserted between the first electrode L1 and a corresponding feeder 17. The fourth transistor Tr4 is a switching element that controls whether or not the first electrode L1 and the data line 14 are electrically connected, and the third transistor Tr3 is a switching element that controls whether or not the first electrode L1 and the feeder 17 are electrically connected. The gate of the fourth transistor Tr4 is connected to the scanning line 121. When the level of the scanning signal GWRT[i] is high, the fourth transistor Tr4 is turned on, and when the level of the scanning signal GWRT[i] is low, the fourth transistor Tr4 is turned off.

An n-channel second transistor Tr2 shown in FIG. 2 is inserted between the drain of the driver transistor Tdr and the feeder 17. The gate of this second transistor Tr2 is connected to the second control line 125. The high level of the second control signal G2[*i*] is set to a potential VC allowing the second transistor Tr2 to be operated in the saturation region thereof, and the low level of the second control signal G2[*i*] is set to the ground potential Gnd allowing the second transistor Tr2 to be turned off.

B: Operations of Electro-Optic Device

Figure 3:
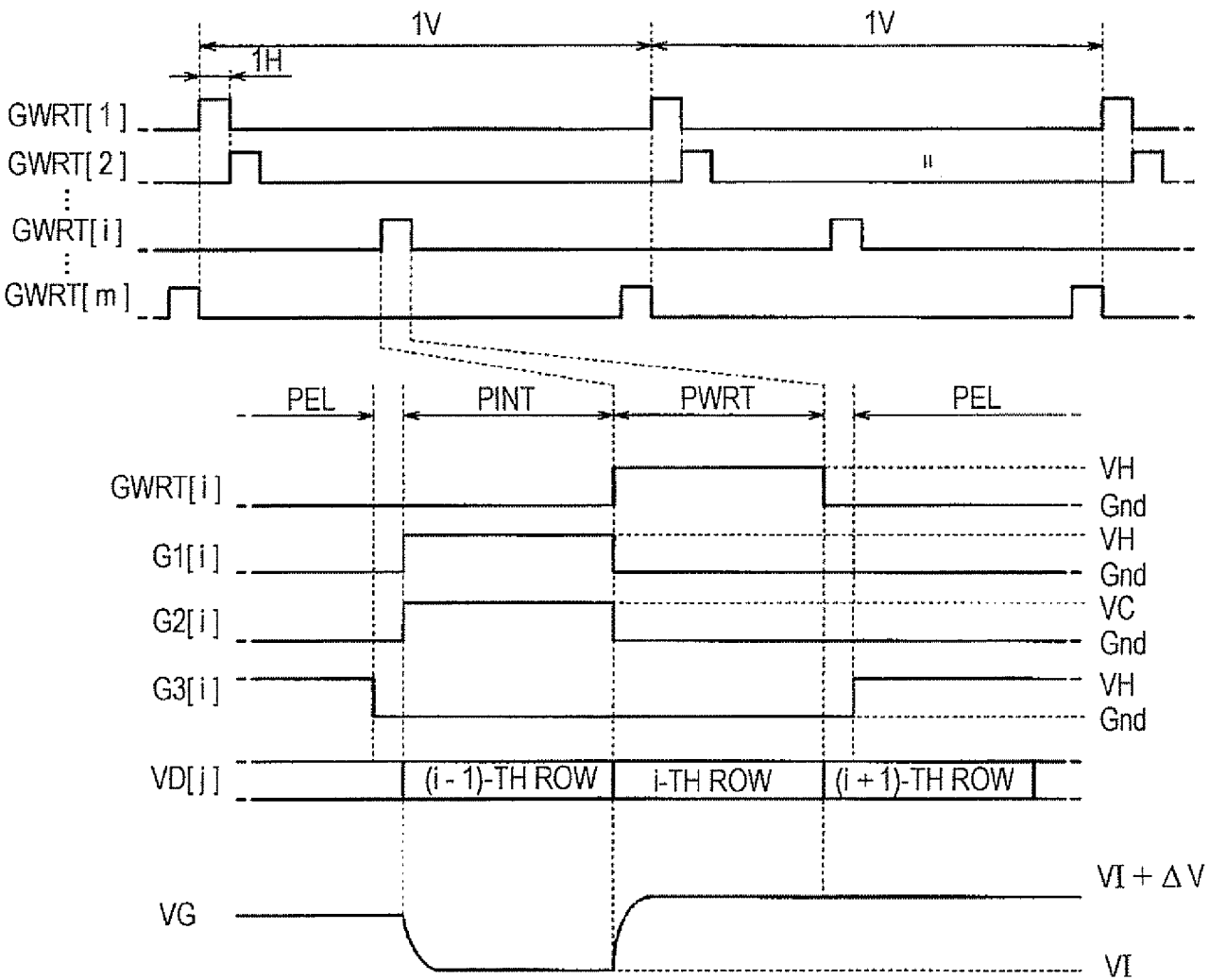
FIG. 3 is a timing chart showing the waveforms of signals.

Next, the specific waveforms of signals generated by the scanning-line-driving circuit 22 will be described with reference to FIG. 3. As shown in FIG. 3, scanning signals GWRT[1] to GWRT[m] are sequentially set to high levels in every horizontal scanning period (1H). In other words, the scanning signal GWRT[i] is maintained at the high level in an i-th horizontal scanning period of a vertical scanning period (1V), and maintained at a low level in the other periods. In the transition of the scanning signal GWRT[i] from the low level to the high level, the selection of the pixel circuits P in the i-th row is performed. Hereinafter, a period in which the level of each of the scanning signals GWRT[1] to GWRT[m] becomes high, i.e., the horizontal scanning period, is referred to as a "writing period PWRT".

Hereinafter, a period immediately before the writing period PWRT, in which the level of the scanning signal GWRT[i] becomes high, is referred to as an "initialization period PINT". The levels of the first and second control signals G1[*i*] and G2[*i*] become high in the initialization period PINT, and the first and second control signals G1[*i*] and G2[*i*] are maintained at low levels in the other periods. Hereinafter, a period from after the writing period PWRT, in which the level of the scanning signal GWRT[i] becomes high, to before the start of the initialization period PINT, in which the levels of the first and second control signals G1[*i*] and G2[*i*] become high, is referred to as a "light-emitting period PEL". The level of the third control signal G3[*i*] becomes high in the light-emitting period PEL, and becomes low in the other periods, i.e., in periods including the initialization period PINT and the writing period PWRT.

Next, the specific operations of one of the pixel circuits P will be described with reference to FIGS. 4 to 7. The operations of the pixel circuit P disposed in the i-th row and the j-th column are described below in correspondence with the initialization period PINT, the writing period PWRT, and the light-emitting period PEL.

(a) Initialization Period PINT

Figure 4:
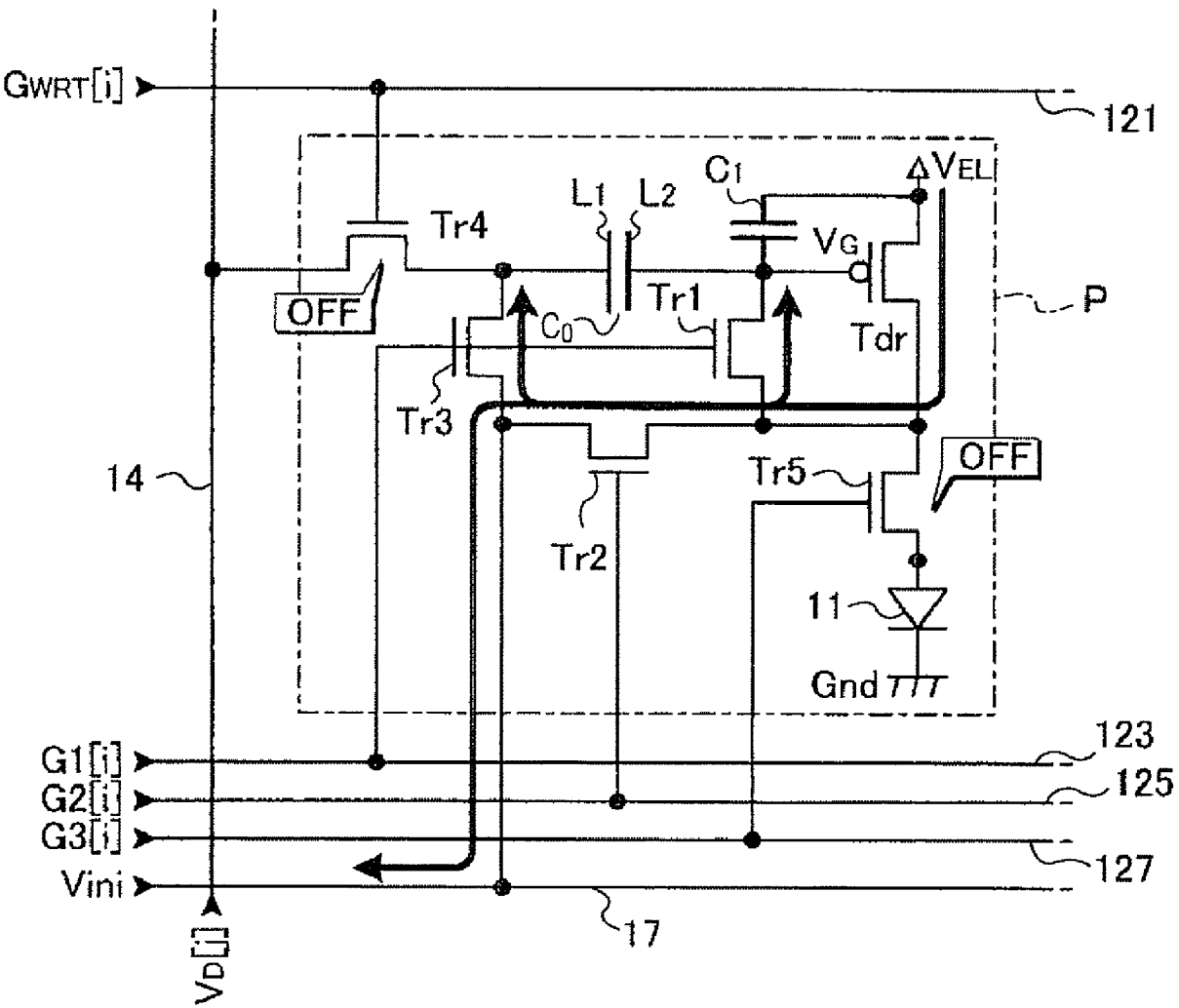
FIG. 4 is a circuit diagram describing an operation of the pixel circuit in an initialization period.

In the initialization period PINT, as shown in FIG. 3, the first and second control signals G1[*i*] and G2[*i*] are maintained at the high levels, and the scanning signal GWRT[i] and the third control signal G3[*i*] are maintained at the low levels. Accordingly, as shown in FIG. 4, the first and third transistors Tr1 and Tr3 are turned on. In this case, the level of the first control signal G1[*i*] is set to a potential VH. The potential VH is set so as to be higher than the power supply potential VEL. As a result, the first and third transistors Tr1 and Tr3 in the first embodiment are operated in the linear regions thereof and turned on. When the first transistor Tr1 is turned on, the driver transistor Tdr is operated as a diode. In contrast, the high level of the second control signal G2[*i*] is set to the potential VC. The potential VC is set such that the second transistor Tr2 can be operated in the saturation region thereof. In the first embodiment, the potential VC is higher than the initialization potential Vini, and is lower than the power supply potential VEL. In other words, the relationship VH>VEL>VC>Vini is obtained.

Figure 5A:
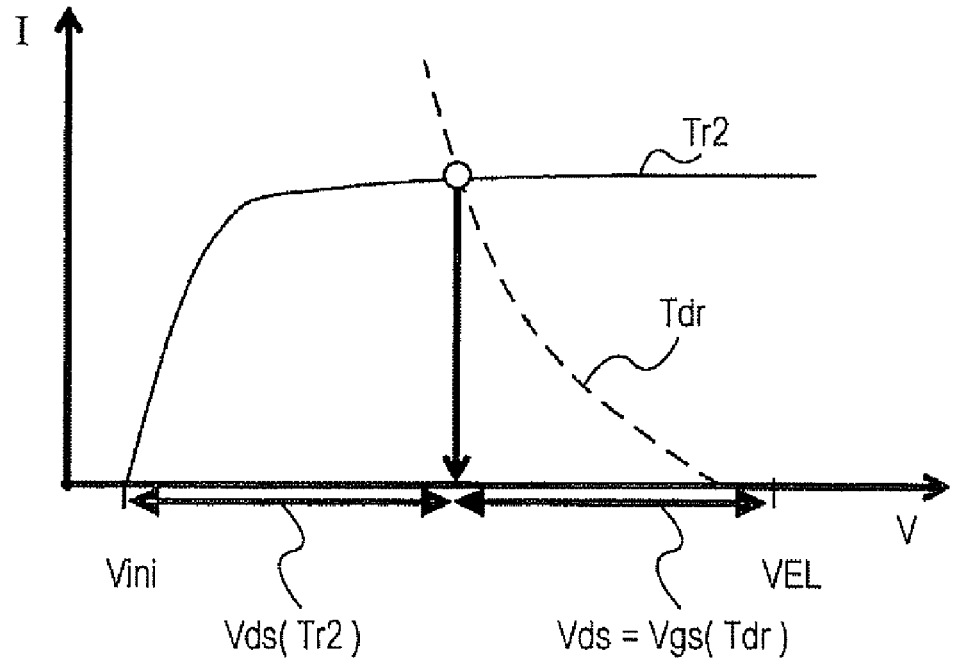
FIGS. 5A and 5B are diagrams describing the operation of the pixel circuit in the initialization period.

The operation of the second transistor Tr2 in the saturation region thereof is significant in terms of compensation of the mobility of the driver transistor Tdr. FIG. 5A shows an operating point of the second transistor Tr2. The solid-line curve in FIG. 5A represents the relationship between a drain voltage V of the second transistor Tr2 and a drain-to-source current I of the second transistor Tr2. The dotted-line curve represents a characteristic of the driver transistor Tdr that is diode-connected. The intersection of these two curves is the operating point of the second transistor Tr2. Accordingly, as the arrows in FIG. 5A indicate, a drain-to-source voltage Vds of the driver transistor Tdr and a drain-to-source voltage Vds of the second transistor Tr2 are determined.

Figure 5B:
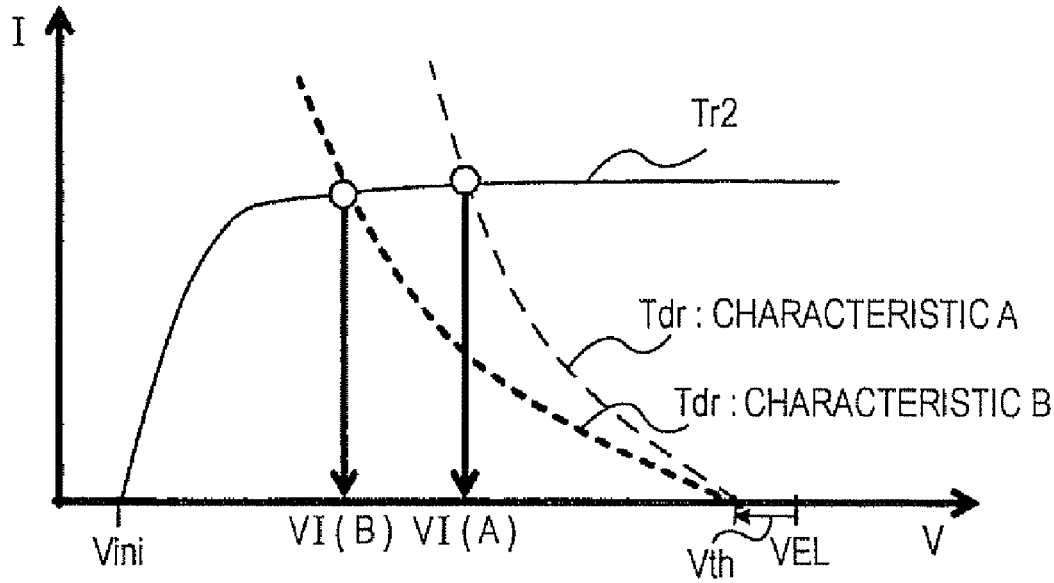

Here, suppose that there are provided two driver transistors Tdr, namely, a driver transistor Tdr having Characteristic A and a driver transistor Tdr having Characteristic B, the threshold Vth of the driver transistor Tdr having Characteristic A is equivalent to that of the driver transistor Tdr having Characteristic B, and the mobility of the driver transistor Tdr having Characteristic A is different from that of the driver transistor Tdr having Characteristic B. FIG. 5B shows that the mobility of the driver transistor Tdr having Characteristic A is larger than that of the driver transistor Tdr having Characteristic B. When a voltage Vgs (=Vds) is applied equivalently to the driver transistor Tdr having Characteristic A and the driver transistor Tdr having Characteristic B, the relationship between a current Ids of the driver transistor Tdr having Characteristic A and a current Ids of the driver transistor Tdr having Characteristic B is as follows: Ids(A)>Ids(B), Referring to FIG. 5B, each of the voltages corresponding to the intersections of the solid-lined curve and the two dotted curves is represented by a potential VI, and more specifically, by a potential VI(A) or VI(B). Since each of the potentials VI(A) and VI(B) is the gate potential VG of the driver transistor Tdr, a gate-to-source voltage Vgs of the driver transistor Tdr having Characteristic A and a gate-to-source voltage Vgs of the driver transistor Tdr having Characteristic B are given as follows:

$$Vgs(A)=VEL-VI(A)$$

$$Vgs(B)=VEL-VI(B)$$

Suppose that the second transistor Tr2 and the driver transistor Tdr have ideal constant-current characteristics. When the gate-to-source voltages Vgs(A) and Vgs(B) are applied to the driver transistor Tdr having Characteristic A and the driver transistor Tdr having Characteristic B, respectively, the amount of the current Ids output from the driver transistor Tdr having Characteristic A is equivalent to that of the current Ids output from the driver transistor Tdr having Characteristic B. In other words, in the first embodiment, the second transistor Tr2 is operated in the saturation region thereof, so that the gate potential VG of the driver transistor Tdr can be adjusted in accordance with the mobility thereof. In the initialization period PINT, when the gate potential VG of the driver transistor Tdr reaches a potential adjusted in accordance with the mobility in this manner, the potential is maintained across a capacitive element C1 of the driver transistor Tdr. The capacitive element C1 may be included in the gate of the driver transistor Tdr as parasitic capacitance.

(b) Writing Period PWRT

Figure 6:
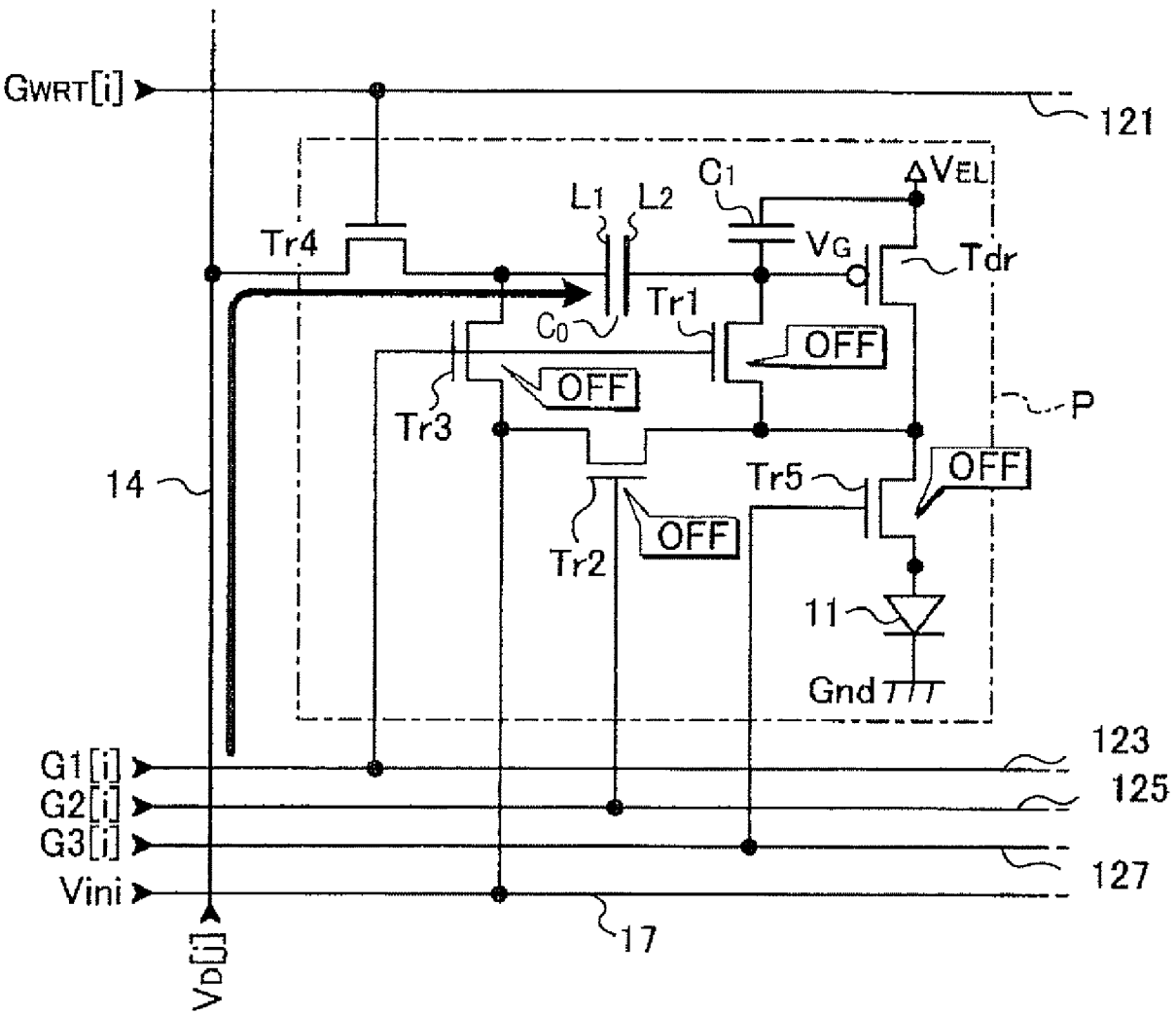
FIG. 6 is a circuit diagram describing an operation of the pixel circuit in a writing period.

In the writing period PWRT, as shown in FIG. 3, the level of the scanning signal GWRT[i] becomes high, and the first to third control signals G1[*i*] to G3[*i*] are maintained at the low levels. Accordingly, as shown in FIG. 6, the first to third transistors Tr1 to Tr3 and the fifth transistor Tr5 are turned off. Conversely, the fourth transistor Tr4 is turned on, whereby the data line 14 and the first electrode L1 are electrically connected. As a result, the potential of the first electrode L1 is changed from the initialization potential Vini, which is supplied in the initialization period PINT, to the data potential VD[j] corresponding to a gradation of the electro-optic element 11.

As shown in FIG. 6, in the writing period PWRT, the first transistor Tr1 is turned off, and the impedance of the gate of the driver transistor Tdr is sufficiently high. Accordingly, when the potential of the first electrode L1 is changed by a change amount ΔV (=Vini−VD[j]) from the initialization potential Vini, which is supplied in the initialization period PINT, to the data potential VD[j], the potential of the second electrode L2 (the gate potential VG of the driver transistor Tdr) is changed from an immediately previous potential (VEL−VI) as a result of capacitive coupling. In this case, the change amount of the potential of the second electrode L2 is determined in accordance with a capacitive ratio of the capacitive element C0 to the capacitive element C1. More specifically, when the capacitance values of the capacitive element C0 and the capacitive element C1 are represented by "C" and "Cs", respectively, the change amount of the potential of the second electrode L2 is determined by "ΔV·C/(C+Cs)". Accordingly, in the writing period PWRT, the gate potential VG of the driver transistor Tdr is stabilized at a level given by equation (1):

$$Vg=VEL-VI-k\cdot\Delta V \tag{1}$$

wherein the equation k=C/(C+Cs) is obtained.

Additionally, the current Ids (=Iel) in the saturation region of the driver transistor Tdr is given by equation (2):

$$Ids=\tfrac{1}{2}*\mu*W/L*Cox*(Vgs-Vth)\hat{}2 \tag{2}$$

wherein "μ" is the mobility of the driver transistor Tdr. When the current Ids in the initialization period PINT is represented by Ids[ini], Ids[ini] is given by equation (3):

$$Ids[ini]=\tfrac{1}{2}*\mu(A)*W/L*Cox*Vgs(A)\hat{}2=\tfrac{1}{2}*\mu(B)*W/L*Cox*Vgs(B)\hat{}2 \tag{3}$$

The reason why equation (3) is obtained is that the potential VI obtained in accordance with the mobility of the driver transistor Tdr is maintained across the capacitive element C1 in the initialization period PINT. As a result, when the change amount ΔV (=Vini−VD[j]) is 0, the current Ids of the driver transistor Tdr having Characteristic A can be equivalent to that of the driver transistor Tdr having Characteristic B although the mobility of the driver transistor Tdr having Characteristic A is different from that of the driver transistor Tdr having Characteristic B. Furthermore, even when data amplitude exists, a variation in current Ids due to a variation in mobility can be more suppressed than that in a case where a pixel circuit having a configuration with two transistors is used or in a case where a compensated threshold of a transistor is used to drive the transistor.

(c) Light-Emitting Period PEL

Figure 7:
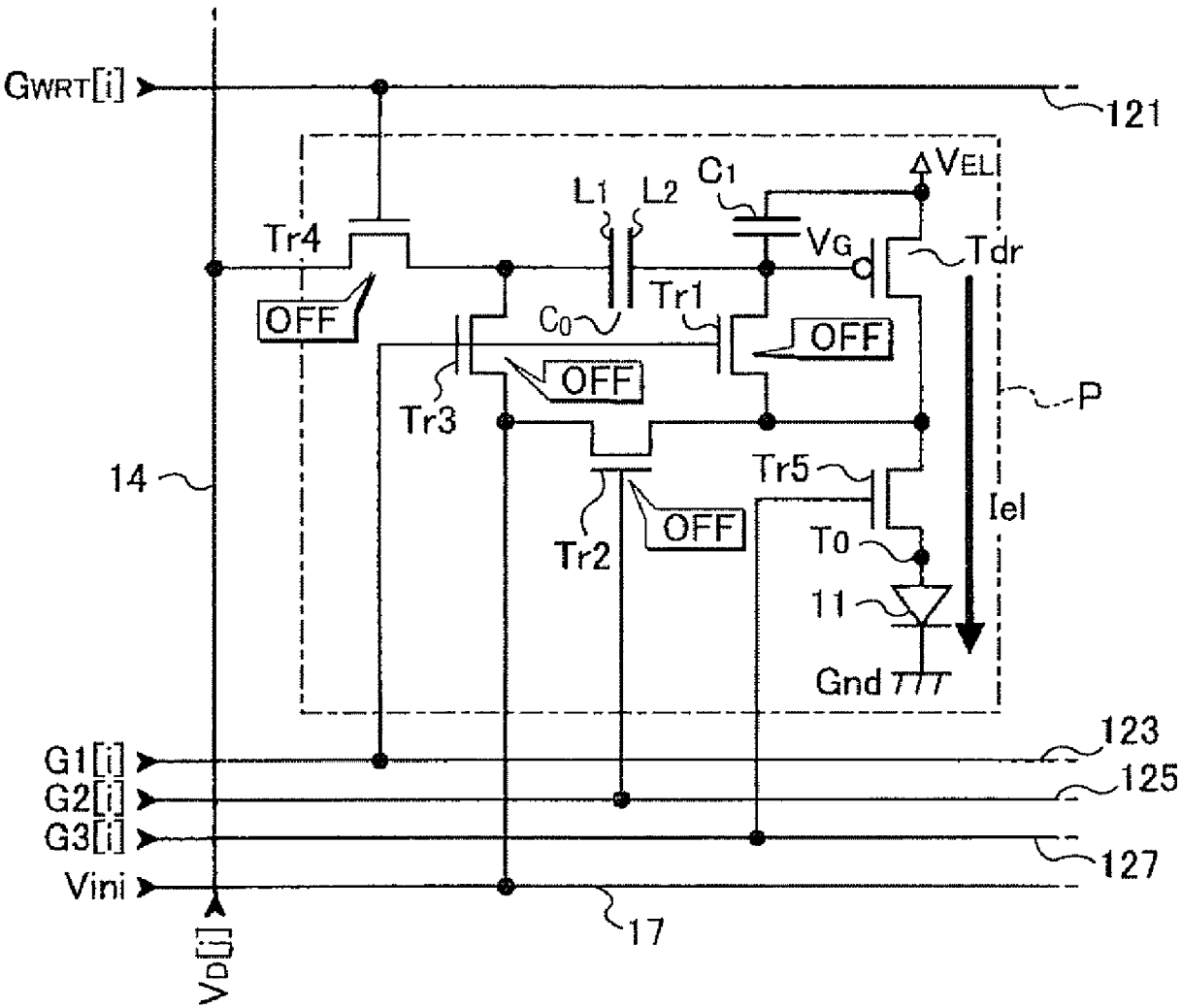
FIG. 7 is a circuit diagram describing an operation of the pixel circuit in a light-emitting period.

In the light-emitting period PEL, as shown in FIG. 3, because the first and second control signals G1[*i*] and G2[*i*] are maintained at the low levels, the first to third transistors Tr1 to Tr3 are turned off. Additionally, because the scanning signal GWRT[i] is maintained at the low level in the light-emitting period PEL, as shown in FIG. 7, the fourth transistor Tr4 is turned off and the fifth transistor Tr5 is turned on. Accordingly, the first electrode L1 of the capacitive element C0 is electrically isolated through the fourth transistor Tr4, which is turned off, from the data line 14.

As a result, in the light-emitting period PEL, the potential of the second electrode L2, which is equivalent to the gate potential VG of the driver transistor Tdr, is fixed to the potential given by equation (1). Thus, the driving current Tel obtained in accordance with the potential is supplied through the driver transistor Tdr and the fifth transistor Tr5 to the electro-optic element 11. This supplied driving current Iel allows the electro-optic element 11 to emit light to obtain a luminance on the basis of the data potential VD[j].

As described above, in this embodiment, since in the initialization period PINT, the second transistor Tr2 is operated in the saturation region thereof, the potential obtained in accordance with the mobility of the driver transistor Tdr can be maintained across the capacitive element C1. Then, in the writing period PWRT, the data potential VD[j] corresponding to the gradation is written so as to be superimposed on this potential. As a result, the mobility of the driver transistor Tdr can be corrected, and at the same time, the electro-optic element 11 can emit light to obtain a luminance corresponding to a gradation to be displayed. Thus, this enables a luminance variation due to a variation in mobility to be markedly suppressed.

Second Embodiment

An electro-optic device according to a second embodiment has a configuration similar to that of the electro-optic device according to the first embodiment shown in FIG. 1. However, the timing of the first control signal G1[*i*] in the electro-optic device according to the second embodiment, which is output from the scanning-line-driving circuit 22, is different from that in the electro-optic device according to the first embodiment.

Figure 8:
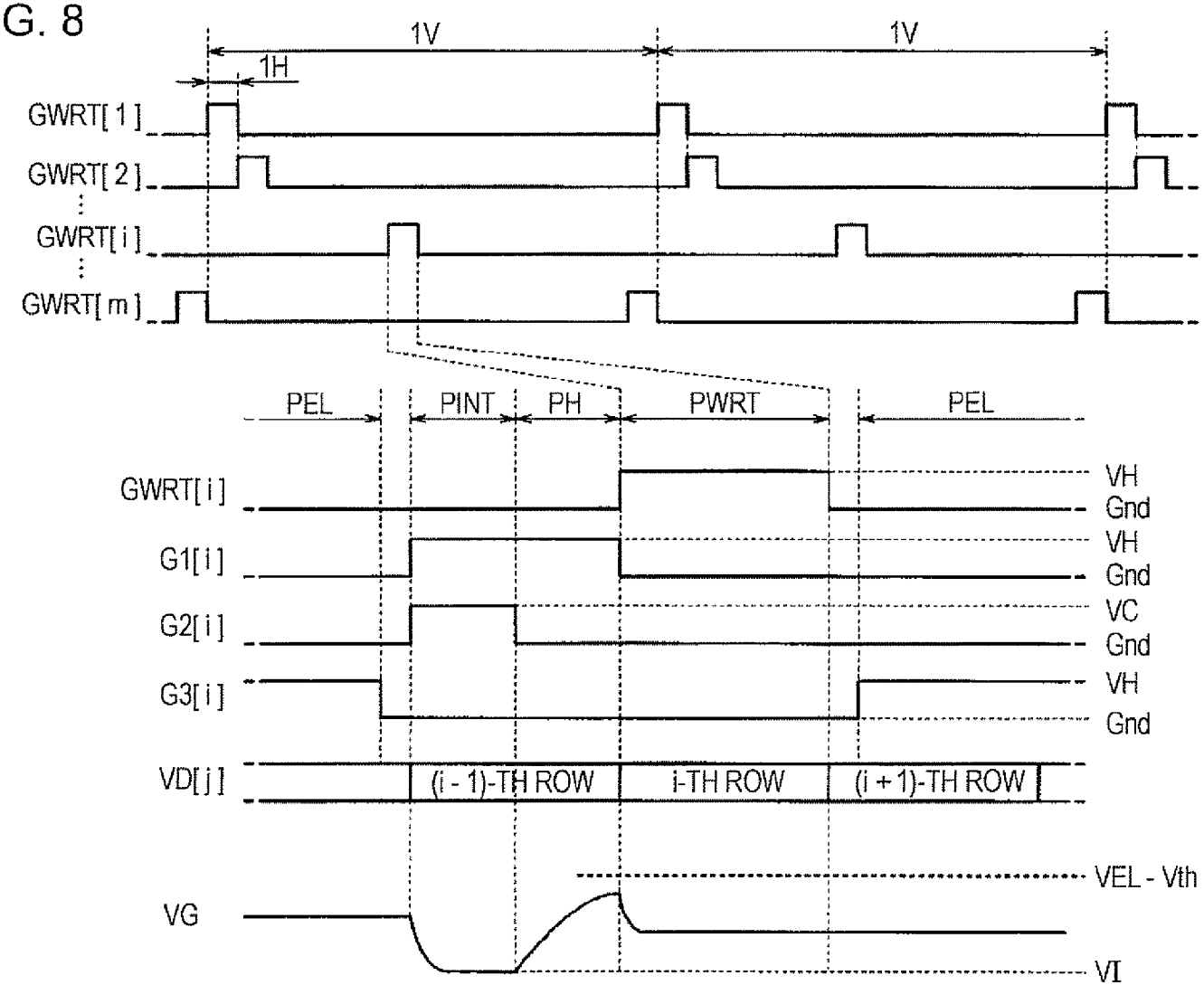
FIG. 8 is a timing chart showing the waveforms of signals of the electro-optic device according to the first embodiment of the invention.

FIG. 8 is a timing chart of the electro-optic device according to the second embodiment. In this embodiment, a compensation period PH is provided between the initialization period PINT and the writing period PWRT. In the compensation period PH, the characteristic variation of the second transistor Tr2 is corrected.

As in the case of the first embodiment, suppose that there are provided two driver transistors Tdr, namely, a driver transistor Tdr having Characteristic A and a driver transistor Tdr having Characteristic B, the threshold Vth of the driver transistor Tdr having Characteristic A is equivalent to that of the driver transistor Tdr having Characteristic B, and the mobility of the driver transistor Tdr having Characteristic A is different from that of the driver transistor Tdr having Characteristic B. In the initialization period PINT, as shown in FIG. 5B, the gate-to-source voltage Vgs of the driver transistor Tdr having Characteristic A and the gate-to-source voltage Vgs of the driver transistor Tdr having Characteristic B are given as follows:

$$Vgs(A)=VEL-VI(A)$$

$$Vgs(B)=VEL-VI(B)$$

Figure 9:
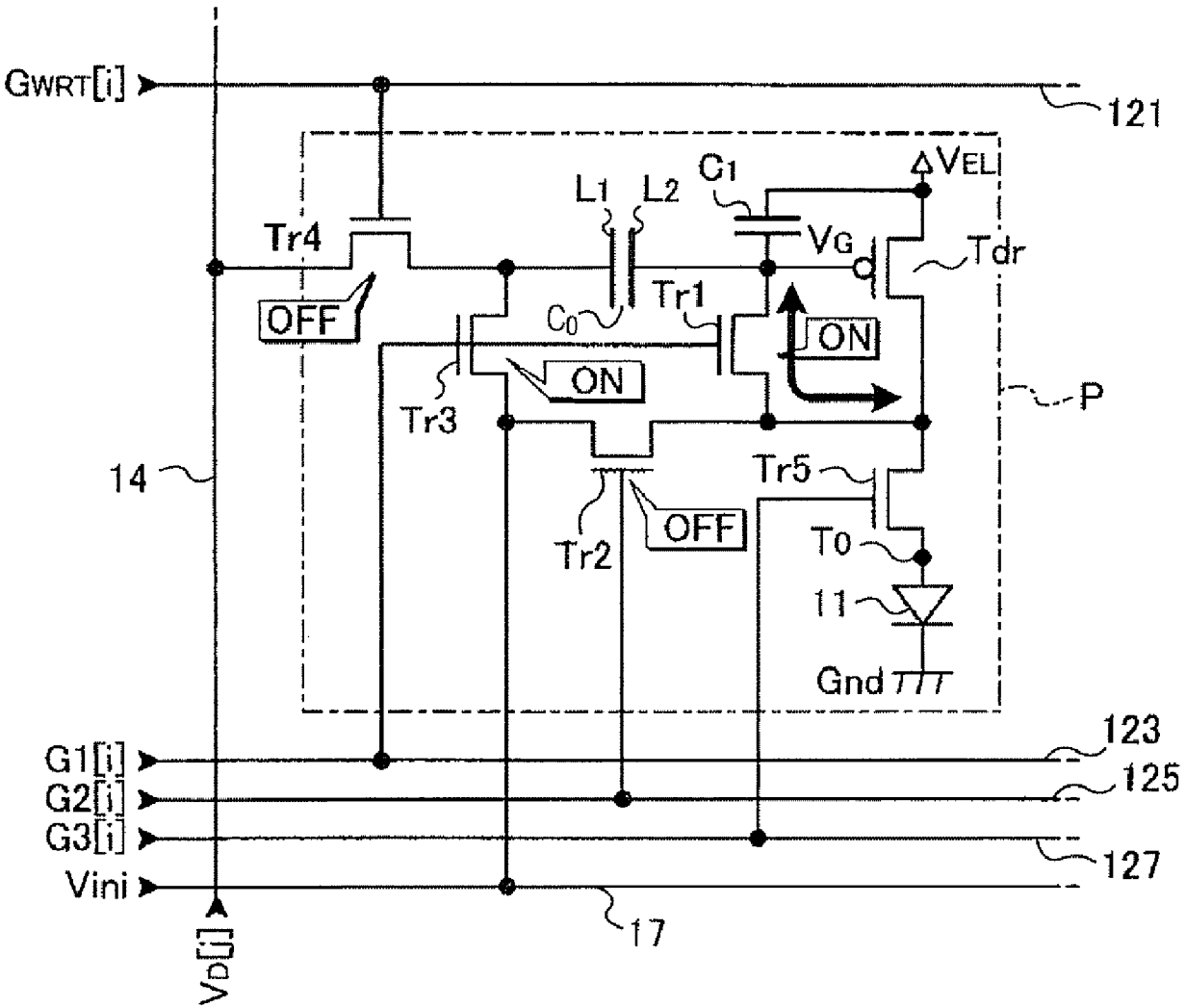
FIG. 9 is a circuit diagram describing an operation of the pixel circuit in a compensation period.

In the compensation period PH, while the first control signal G1[*i*] is maintained at the high level, the level of the second control signal G2[*i*] becomes low. Accordingly, the pixel circuit P is operated as shown in FIG. 9. The gate potential VG of the driver transistor Tdr is equivalent to the potential VI at the beginning of the compensation period PH but increases to a potential (VEL−Vth).

Figure 10:
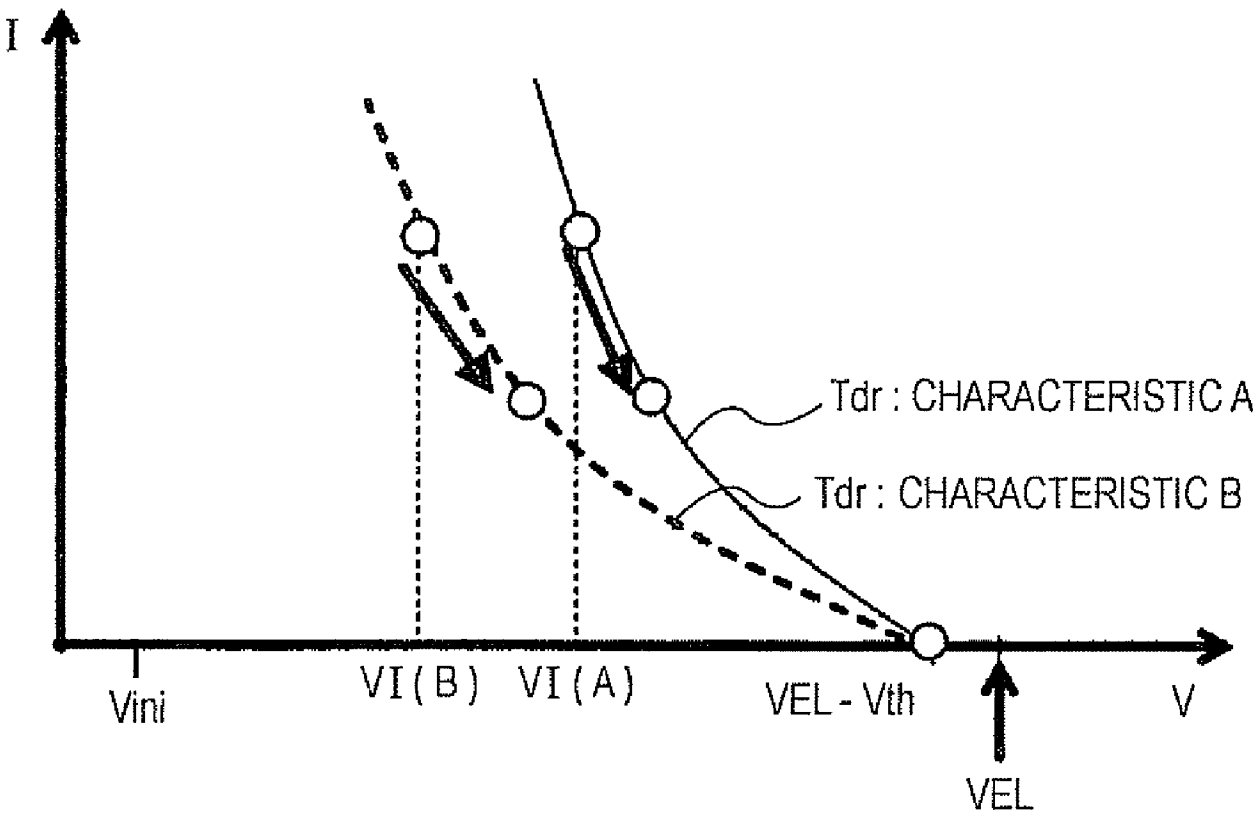
FIG. 10 is a diagram describing changes of operating points of driver transistors Tdr in the compensation period.

An operating point of the driver transistor Tdr having Characteristic A and an operation point of the driver transistor Tdr having Characteristic B are changed as the arrows in FIG. 10 indicate. When the length of the compensation period PH is sufficient, the gate potential VG becomes (VEL−Vth). The only one difference between the driver transistor Tdr having Characteristic A and the driver transistor Tdr having Characteristic B is mobility. When a voltage Vgs is applied equivalently to the driver transistor Tdr having Characteristic A and the driver transistor Tdr having Characteristic B, the relationship between a current Ids of the driver transistor Tdr having Characteristic A and a current Ids of the driver transistor Tdr having Characteristic B is as follows: Ids(A)>Ids(B). In a case where the equation ΔIds=Ids(A)−Ids(B) is obtained, as the gate potential VG approaches (VEL−Vth), oppositely, ΔIds becomes large. For this reason, in terms of correction of the mobility, it is preferable that the compensation period PH be finished before the gate potential VG reaches (VEL−Vth).

Figure 11A:
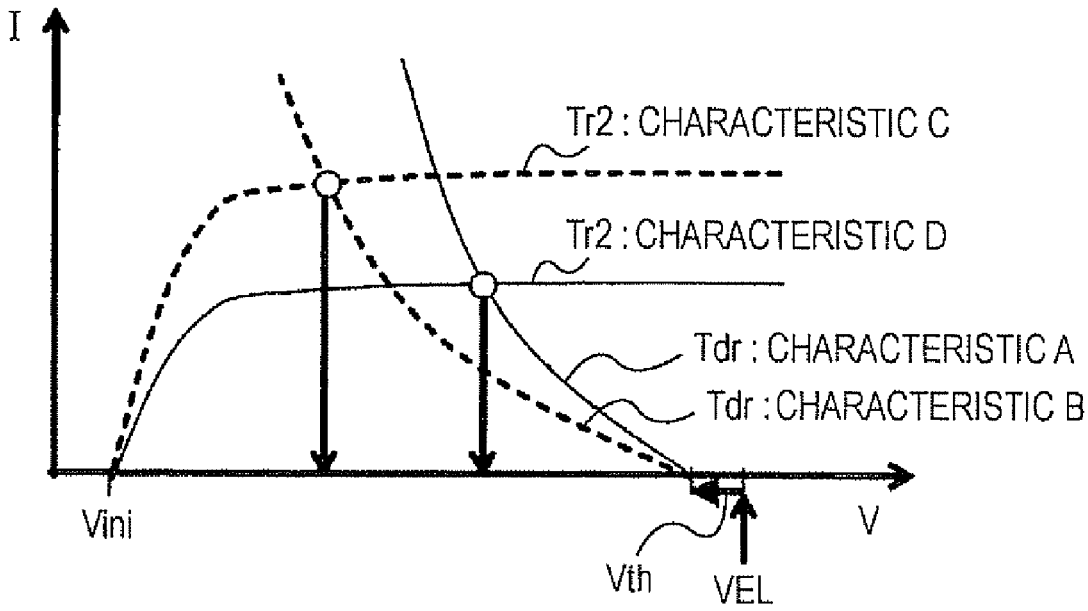
FIGS. 11A and 11B are diagrams describing changes of operating points of the driver transistors Tdr in a case where the characteristic of the second transistor Tr2 varies.

In the first embodiment, a negative effect caused by a variation in electric characteristic of the second transistor Tr2 may occur. However, by using a method of compensating the characteristics of the transistors, this negative effect can be suppressed. An advantage of the method of compensating the characteristics of the transistors will be described with reference to FIGS. 11A and 11B. In this embodiment, as shown in FIG. 11A, suppose that there are provided two second transistors Tr2 having different Vds-to-Ids characteristics, namely, a second transistor Tr2 having Characteristic C and a second transistor Tr2 having Characteristic D. Such a difference of the characteristic of the second transistor Tr2 can be occurred due to a variation in mobility or threshold voltage of the second transistor Tr2.

Figure 11B:
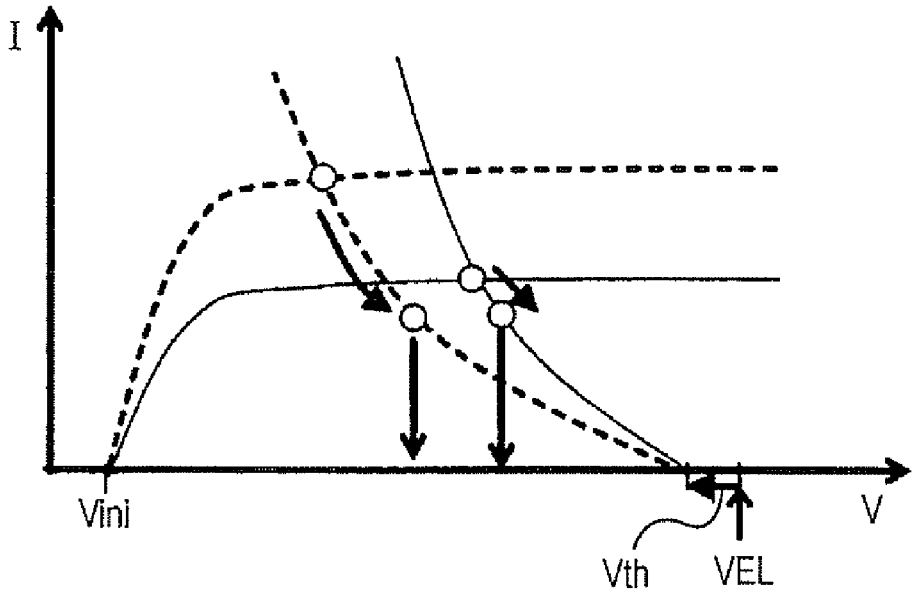

In the first embodiment, the compensation period PH is not provided. For this reason, when the characteristic of the second transistor Tr2 varies, the characteristic variation influences the gate-to-source voltage Vgs(A) of the driver transistor Tdr having Characteristic A and the gate-to-source voltage Vgs(B) of the driver transistor Tdr having Characteristic B. As a result, the difference between the gate-to-source voltage Vgs(A) of the driver transistor Tdr having Characteristic A and the gate-to-source voltage Vgs(B) of the driver transistor Tdr having Characteristic B becomes large more than necessary. In contrast, when the compensation period PH is provided, as shown in FIG. 11B, an operating point of the driver transistor Tdr having Characteristic A and an operating point of the driver transistor Tdr having Characteristic B are changed to (VEL−Vth). As a result, the characteristic variation of the second transistor Tr2 can be corrected. Thus, even when the characteristic of the second transistor Tr2 varies, the characteristic variations in mobility and threshold of the driver transistor Tdr can be corrected. Therefore, a variation in luminance can be markedly suppressed, resulting in an improved display quality.

In the above-described embodiments, an OLED element is only an example of the electro-optic element 11. For example, instead of an OLED element, any of various light-emitting elements, such as an inorganic EL element or a light-emitting diode (LED), may be used as an electro-optic element according to an embodiment of the invention. In other words, any element having a configuration in which a gradation (typically, a luminance) thereof is changed by supplying a current thereto can be sufficiently used as an electro-optic element according to an embodiment of the invention, and the specific configuration of the element is insignificant.

APPLICATIONS

Figure 12:
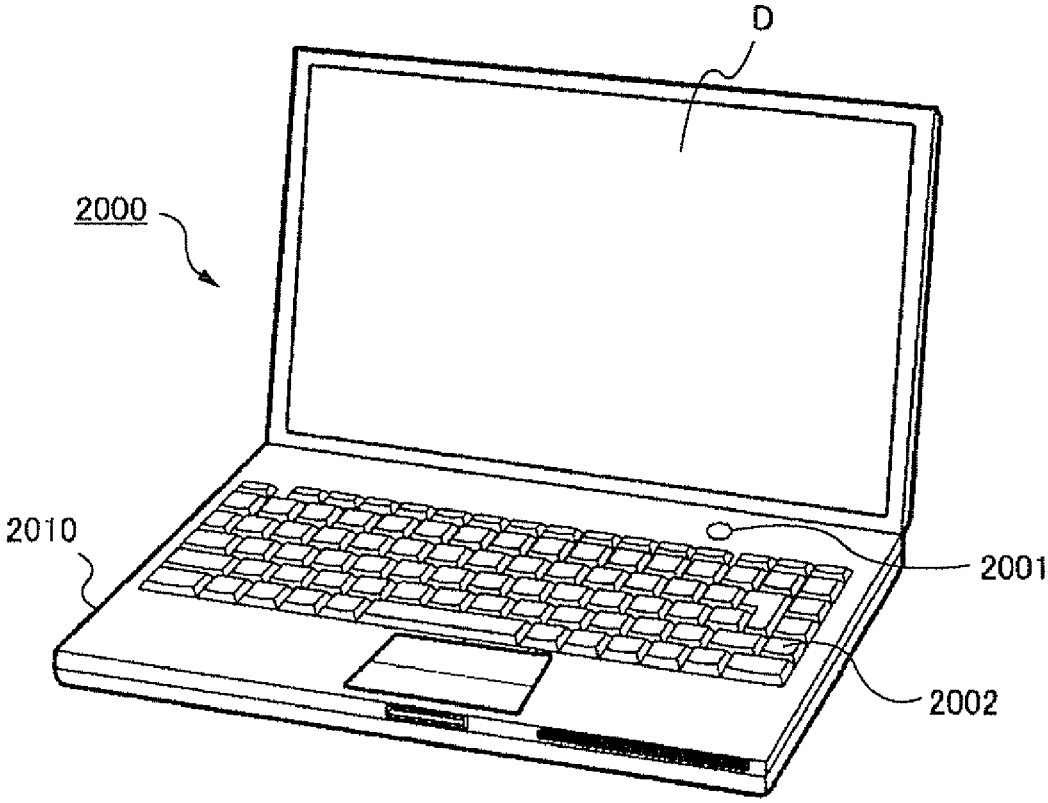
FIG. 12 is a perspective view of a specific example of an electronic apparatus according to an embodiment of the invention.

Next, an electronic apparatus that utilizes an electro-optic device D according to an embodiment of the invention will be described. FIG. 12 is a perspective view of a mobile personal computer that utilizes the electro-optic device D according to any one of the embodiments described above as a display device. A personal computer 2000 includes the electro-optic device D, which is used as a display device, and a main unit 2010. On the main unit 2010, a power switch 2001 and a keyboard 2002 are provided. Because the electro-optic device D uses an OLED element as the electro-optic element 11, the electro-optic device D can display an easily visible screen with a wide viewing angle.

Figure 13:
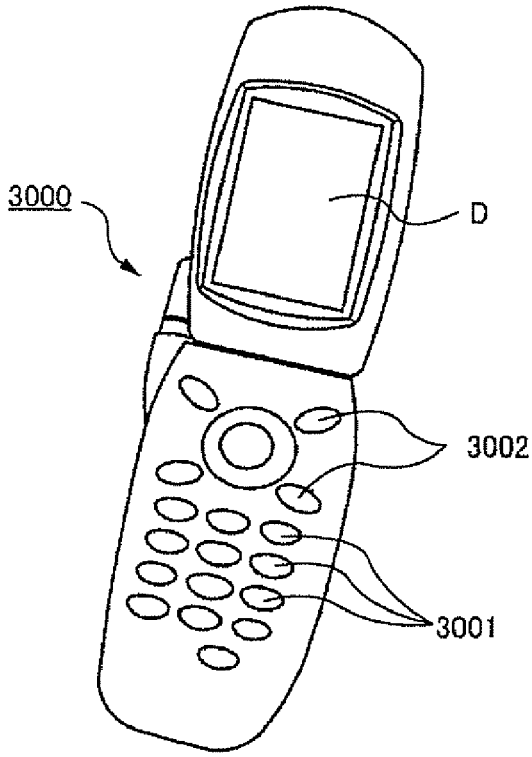
FIG. 13 is a perspective view of a specific example of an electronic apparatus according to an embodiment of the invention.

FIG. 13 shows the configuration of a mobile phone to which an electro-optic device D according to an embodiment is applied. A mobile phone 3000 includes control buttons 3001, scroll buttons 3002, and the electro-optic device D used as a display device. By controlling the scroll buttons 3002, a screen displayed on the electro-optic device D is scrolled.

Figure 14:
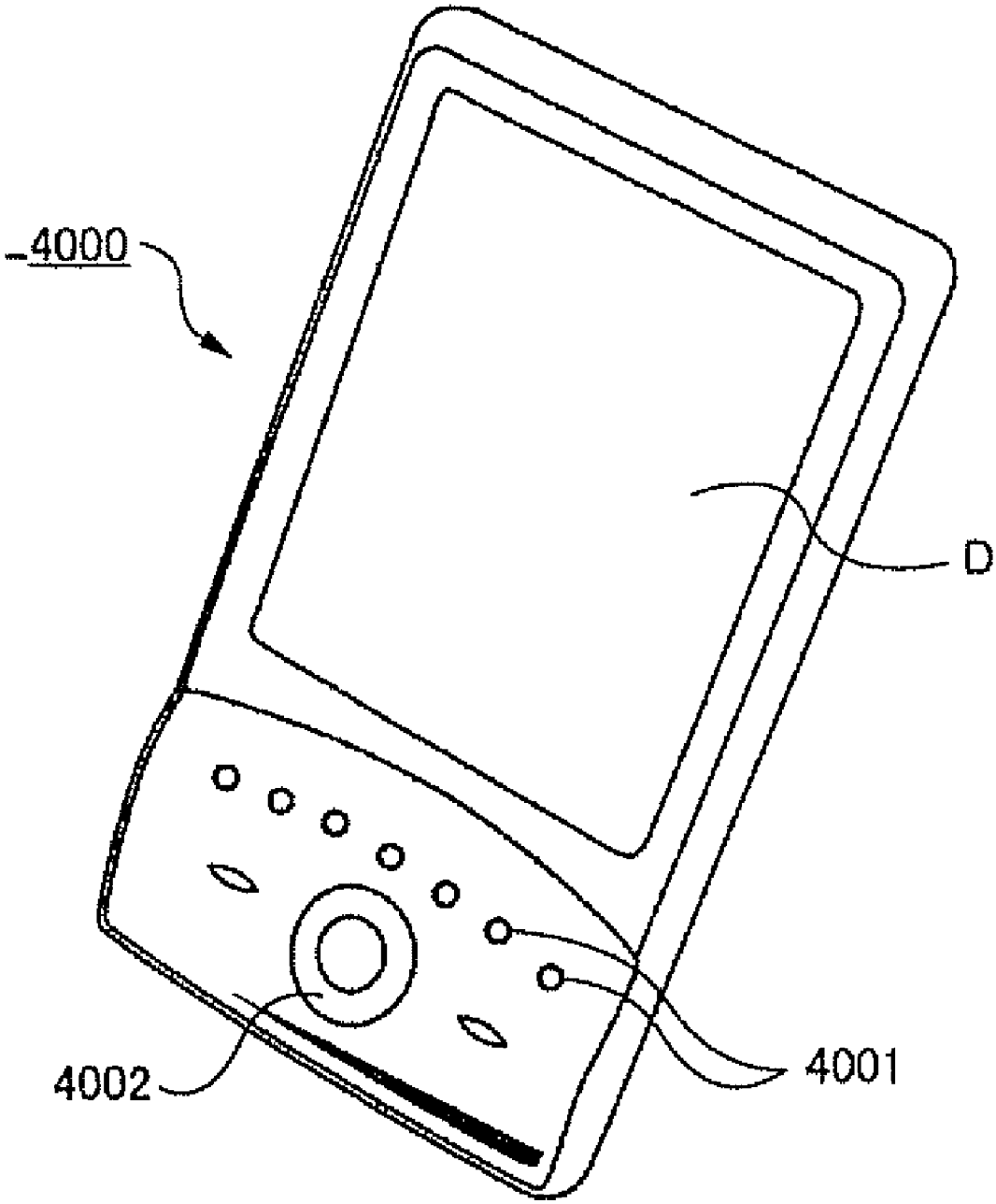
FIG. 14 is a perspective view of a specific example of an electronic apparatus according to an embodiment of the invention.

FIG. 14 shows the configuration of a personal digital assistant (PDA) to which an electro-optic device D according to an embodiment is applied. A PDA 4000 includes control buttons 4001, a power switch 4002, and the electro-optic device D used as a display device. When the power switch 4002 is controlled, various types of information, such as address book or schedule book, is displayed on the electro-optic device D.

Examples of an electronic apparatus to which an electro-optic device according to an embodiment of the invention is applied include the electronic apparatuses shown in FIGS. 12 to 14. Additionally, the examples include, for example, a digital still camera, a television set, a video camera, a car navigation system, a pager, a digital diary, electronic paper, a calculator, a word processor, a workstation, a videophone, a point-of-sales (POS) terminal, a printer, a scanner, a copier, a video player, and an apparatus provided with a touch panel. Furthermore, the application of an electro-optic device according to an embodiment of the invention is not limited to displaying of an image. For example, in an image-forming apparatus, such as an optical writing printer or an electronic copier, a write head that exposures a photosensitive member on the basis of an image to be formed on a recording material, such as paper, is used. An electro-optic device according to an embodiment of the invention can be also utilized as this type of write head. Electronic circuits in the embodiments of the invention include not only a pixel circuit included in a pixel of a display device as in the cases of the embodiments but also a unit circuit for an exposure in an image-forming apparatus.

The entire disclosure of Japanese Patent Application No: 2007-058186, filed Mar. 8, 2007 is expressly incorporated by reference herein.

What is claimed is:

1. A method for driving a pixel circuit including a light-emitting element that emits light whose amount corresponds to a driving current, a driver transistor that supplies the driving current to the light-emitting element, a first transistor provided between a gate of the driver transistor and a drain of the driver transistor, a second transistor provided between the drain of the driver transistor and a node used to supply an initialization potential, the initialization potential being a non-zero potential, and a capacitive element one terminal of which is connected to the gate of the driver transistor, the method comprising:

supplying a fixed potential to the other terminal of the capacitive element and supplying a predetermined potential allowing the second transistor to be operated in a saturation region thereof to a gate of the second transistor in an initialization period in which the first transistor is turned on; and supplying a potential corresponding to a gradation to be displayed to the other terminal of the capacitive element in a writing period after the initialization period is finished.

2. The method for driving a pixel circuit according to claim 1, further comprising:

supplying the fixed potential to the other terminal of the capacitive element and supplying a potential allowing the second transistor to be turned off to the gate of the second transistor in a compensation period provided between the initialization period and the writing period.

3. An electro-optic device comprising:

a plurality of data lines;

a plurality of scanning lines;

a plurality of pixel circuits provided in correspondence with intersections of the plurality of data lines and the plurality of scanning lines, each of the plurality of pixel circuits including a driver transistor that generates a driving current on the basis of a potential of a gate of the driver transistor, an electro-optic element having a gradation obtained on the basis of the driving current generated by the driver transistor, a capacitive element having one terminal connected to the gate of the driver transistor, a first transistor which is provided between the gate of the driver transistor and a drain of the driver transistor, and a gate of which is supplied with a first control signal defining an initialization period, a second transistor which is provided between the drain of the driver transistor and a node used to supply an initialization potential, the initialization potential being a non-zero potential, and a gate of which is supplied with a second control signal defining the initialization period, a third transistor which is provided between the node and the other terminal of the capacitive element, and a gate of which is supplied with the first control signal, and a fourth transistor which is provided between the other terminal of the capacitive element and a corresponding one of the plurality of data lines, and a gate of which is supplied with a scanning signal defining a writing period via a corresponding one of the plurality of scanning lines;

a first driving unit that supplies a data potential corresponding to a gradation to a corresponding one of the plurality of data lines; and a second driving unit that generates the first and second control signals and supplies the scanning signal to a corresponding one of the plurality of scanning lines, wherein the second driving unit sets a potential of the first control signal in the initialization period to a potential allowing the first and third transistors to be turned on, and sets a potential of the first control signal in the writing period to a potential allowing the first and third transistors to be turned off, wherein the second driving unit sets a potential of the second control signal in the initialization period to a predetermined potential allowing the second transistor to be operated in a saturation region thereof, and sets a potential of the second control signal in the writing period to a potential allowing the second transistor to be turned off, and wherein the second driving unit sets a potential of the scanning signal in the initialization period to a potential allowing the fourth transistor to be turned off, and sets a potential of the scanning signal in the writing period to a potential allowing the fourth transistor to be turned on.

4. An electro-optic device comprising:

a plurality of data lines;

a plurality of scanning lines;

a plurality of pixel circuits provided in correspondence with intersections of the plurality of data lines and the plurality of scanning lines, each of the plurality of pixel circuit including a driver transistor that generates a driving current on the basis of a potential of a gate of the driver transistor, an electro-optic element having a gradation obtained on the basis of the driving current generated by the driver transistor, a capacitive element having one terminal connected to the gate of the driver transistor, a first transistor which is provided between the gate of the driver transistor and a drain of the driver transistor, and a gate of which is supplied with a first control signal defining an initialization period and a compensation period, a second transistor which is provided between the drain of the driver transistor and a node used to supply an initialization potential, the initialization potential being a non-zero potential, and a gate of which is supplied with a second control signal defining the initialization period, a third transistor which is provided between the node and the other terminal of the capacitive element, and a gate of which is supplied with the first control signal, and a fourth transistor which is provided between the other terminal of the capacitive element and a corresponding one of the plurality of data lines, and a gate of which is supplied with a scanning signal defining a writing period via a corresponding one of the plurality of scanning lines;

a first driving unit that supplies a data potential corresponding to a gradation to a corresponding one of the plurality of data lines; and a second driving unit that generates the first and second control signals and supplies the scanning signal to a corresponding one of the plurality of scanning lines, wherein the second driving unit sets a potential of the first control signal in the initialization period and the compensation period to a potential allowing the first and third transistors to be turned on, and sets a potential of the first control signal in the writing period to a potential allowing the first and third transistors to be turned off, wherein the second driving unit sets a potential of the second control signal in initialization period to a predetermined potential allowing the second transistor to be operated in a saturation region thereof, and sets a potential of the second control signal in the compensation period and the writing period to a potential allowing the second transistor to be turned off, and wherein the second driving unit sets a potential of the scanning signal in the initialization period and the compensation period to a potential allowing the fourth transistor to be turned off, and sets a potential of the scanning signal in the writing period to a potential allowing the fourth transistor to be turned on.

5. The electro-optic device according to claim 4, wherein each of the plurality of pixel circuits further includes a fifth transistor which is provided between the driver transistor and the electro-optic element, and a gate of which is supplied to a third control signal defining a light-emitting period, wherein the second driving unit sets a potential of the first control signal in the initialization period and the compensation period to the potential allowing the first and third transistors to be turned on, and sets a potential of the first control signal in the writing period and the light-emitting period to the potential allowing the first and third transistors to be turned off, wherein the second driving unit sets a potential of the second control signal in the initialization period to the predetermined potential allowing the second transistor to be operated in a saturation region thereof, and sets a potential of the second control signal in the compensation period, the writing period, and the light-emitting period to the potential allowing the second transistor to be turned off, wherein the second driving unit sets a potential of the scanning signal in the initialization period, the compensation period, and the light-emitting period to the potential allowing the fourth transistor to be turned off, and sets a potential of the scanning signal in the writing period to the potential allowing the fourth transistor to be turned on, and wherein the second driving unit sets a potential of the third control signal in the initialization period, the compensation period, and the writing period to a potential allowing the fifth transistor to be turned off, and sets a potential of the third control signal in the light-emitting period to a potential allowing the fifth transistor to be turned on.

6. An electronic apparatus comprising the electro-optic device according to claim 3.

* * * * *